United States Patent [19]

Kobatake et al.

[11] 4,026,095

[45] May 31, 1977

[54] VARIABLE PASSAGE TYPE YARN GUIDE ARRANGEMENT

[75] Inventors: Takashi Kobatake; Kyosuke Takeda; Sadao Nishide; Tetsuo Saito, all of Moriyama, Japan

[73] Assignee: Asahi Kasei Kogyo Kabushiki Kaisha, Osaka, Japan

[22] Filed: Oct. 16, 1975

[21] Appl. No.: 622,919

[30] Foreign Application Priority Data

Oct. 16, 1974 Japan ..... 49-118792
Oct. 16, 1974 Japan ..... 49-118793

[52] U.S. Cl. ..... 57/34.5; 57/34 R; 242/18 R

[51] Int. Cl.[2] ..... D01H 9/02; D01H 9/16

[58] Field of Search ..... 57/34 R, 34.5, 52, 56, 57/57, 75; 242/18 R

[56] References Cited

UNITED STATES PATENTS

| | | | |
|---|---|---|---|
| 2,572,138 | 10/1951 | Griset | 57/34.5 X |
| 2,822,661 | 2/1958 | Farrady et al. | 57/75 X |
| 3,568,425 | 3/1971 | Zegna et al. | 57/34.5 X |
| 3,801,030 | 4/1974 | Kobatake et al. | 242/18 R |
| 3,807,155 | 4/1974 | Miyazaki et al. | 57/34.5 X |

*Primary Examiner*—Donald Watkins
*Attorney, Agent, or Firm*—Sughrue, Rothwell, Mion, Zinn & Macpeak

[57] ABSTRACT

The invention proposes an improved yarn winding arrangement including a series of bobbins and spindles. The arrangement includes a fluid operated yarn sucking and projecting unit positioned at a distance substantially above its related bobbin and in close proximity to the starting point of the yarn balloon formed directly above the bobbin. A first fluid operated, waste yarn sucker is operatively connected with the unit. A second fluid operated waste yarn sucker is positioned in proximity to the root end of the yarn for receiving the yarn projecting fluidically from the discharge end of the aforementioned unit. The unit includes a sleeve as its main body formed with a longitudinally extending slot for sucking therethrough the yarn for deviating it from its regular running course to a wasting one.

5 Claims, 13 Drawing Figures

VARIABLE PASSAGE TYPE YARN GUIDE ARRANGEMENT

This invention relates to an improved yarn winding arrangement, especially adapted for being combined with a number of parallel arranged spindle-bobbin units ready for execution of an automatic bobbin exchange operation.

It is very difficult to execute initial yarn threading on a series of bobbin winding units employing draw twisters or the like means operating in the ring twisted principle, for the purpose of realization of a continuous yarn winding and automatic bobbin exchange. The practical difficulties in this respect are very substantial and those persons skilled in the art have devoted themselves for solving these difficulties. However, according to our knowledge, industrial success in this respect has not yet been realized.

As an example, a yarn-sucking device or yarn take out unit has been advantageously employed for continuous treatment of the yarn after, as an example, completion of a yarn winding-up operation on a bobbin. However, such device or unit has been used in an independent and thus non-automatic manner from the operation stages of the bobbin winder. Therefore, labor consumption was high in the intentional and individual interruption of the continuous yarn supply during the bobbin exchange stage and in the manual and renewal attachement of the yarn end to the traveler at the reinitiation stage of yarn winding. Additional labor was required for manual yarn end attachment to a new bobbin brought to the yarn winding position in place of the foregoing full bobbin. These and further manual jobs were repeated during the bobbin exchange stage for a yarn winding unit. Therefore, an automatic and simultaneous bobbin exchange for a number of the winding units has not yet been realized in practice.

There are several proposals for attaining the automatic bobbin exchange, destined for the above purpose, by repeating a scheduled program of winding and bobbin exchanging stages. As an example, and as described in Japanese patent publication No. 46-8448 of 1971, it is proposed to provide a lateral yarn passage bore at the root portion of the spindle, being intended for making registration with a yarn suction opening formed through the bobbin and opening at one side thereof, when the bobbin has been brought to its operating position on the former. The suction passage of the spindle is arranged ready for connection at its opposite side with a suction pipe. It is intended to bring the yarn end to a position in close proximity to the yarn-introducing mouth on the bobbin, for fluidically sucking the yarn end thereinto. Since the suction passage through the spindle root must follow a broken path the boring job is highly complicated. In addition, the desired registration of the related lateral bores in spindle and bobbin can not be easily determined at each bobbin exchange stage.

As an alternative measure described in Japanese patent publication No. 48-44533 of 1973, a yarn suction pipe is provided in proximity to the yarn winding meachanism for artificially sucking-in-the yarn end when the spindle has been brought to dead stop ready for bobbin exchange. The yarn end is brought into successive engagement with a yarn-catching hook and a yarn-cutting recess provided on the spindle root portion when the bobbin attached to the spindle initiates its rotational movement, so as to form a newly cut yarn end, while at the same time, vacuum supply to the yarn sucking-in pipe is interrupted for establishing the yarn threading on the bobbin. Even in this proposed arrangement, the introduction of the yarn end into the suction pipe must be carried into effect only in an artificial way and during each bobbin exchange stage. Therefore, the operation would be highly troublesome and laborious.

As a last prior proposal described in U.S. Pat. No. 3,801,030, a pressure fluid injection nozzle is positioned at the starting point of the yarn traverse movement for driving the yarn end downwards into a suction nozzle positioned in close proximity to one end of the bobbin, the latter nozzle being also of a fluidically operating type, so as to deviate the yarn running route from the regular one. It should be noted, however, the thus deviated yarn-running direction is only one way. Therefore, a substantial limitation would be imposed upon the adaptability of the proposed apparatus.

In the case of a continuously operating and bobbin exchangeable yarn winding machine, the running yarn is at first wasted, the full bobbin is exchanged for a new one and the waste yarn must finally be brought onto the latter. Since, however, in the last mentioned proposal, the yarn is deviated from the regular running direction to only one modified direction, the yarn in such condition must meet with various requirements until ready for performing the winding operation by the bobbin.

It should be stressed at this stage that the draw twisters arranged in the yarn winding machine which is highly crowded due to the small interspindle spacing and limited spindle height, can only have a limited idle space. Such spacial limitation is further accentuated by the provision of ring travelers and various machine parts. Space is further consumed for the drawing-out of the bobbins from respective spindles and reattachment thereof in position. Much difficulty could be encountered in the application of the above proposed yarn shift and deviating mechanisms to the very crowded winding machine.

It is therefore the main object of the present invention to provide a continuously operable yarn winding unit even if the winding machine allows only a limited space for the bobbin exchange and its related jobs.

It is a further object to provide an improved yarn winding unit of the above kind which provides a highly stabilized operation, yet with a rather simple and convenient machine structure.

According to this invention, a yarn winding arrangement includes a series of bobbins; said arrangement comprising a yarn sucking and projecting unit positioned at a distance substantially above said bobbin and in close proximity to the starting point of a yarn balloon, first waste yarn sucking means operatively connected with said unit and a second waste yarn sucking means adapted for receiving a yarn projected fluidically from said unit and positioned in proximity of the root end of said bobbin is provided.

Said unit comprises as fluid inlet pipe and a sleeve mechanically connected with each other, said sleeve having a longitudinally slot closed at its upper end and opened at its lower end.

The yarn winding arrangement may further comprises a cutter positioned in close proximity to said second waste yarn sucking means and at a slightly higher level from the yarn receiving upper end of the latter, said cutter being reciprocatingly movable between its receded off-service position and its advanced service position.

The yarn winding arrangement according to this invention may further comprise a yarn pusher positioned in close proximity to said second waste yarn sucking means and at a slightly higher level from the upper yarn receiving end of the latter, said yarn pusher being reciprocatingly movable between its receded off-service position and its advanced service position. The said unit is preferably formed with two separated yarn guides so as to guide the yarn substantially along a yarn passage parallel to said sleeve and positioned outside of said unit, but in proximity thereto, when the bobbin is executing its regular yarn winding operation.

These and further objects, features and advantages of the invention will become more apparent when read the following detailed description of the invention with reference to the accompanying drawings, in which FIG. 1 is a perspective elevational view of a variable passagge type yarn guiding unit of the yarn winding arrangement according to the invention, acting as a predominantly important means for yarn sucking and projection and unitedly connected with a first waste yarn sucking means.

Figure 2:
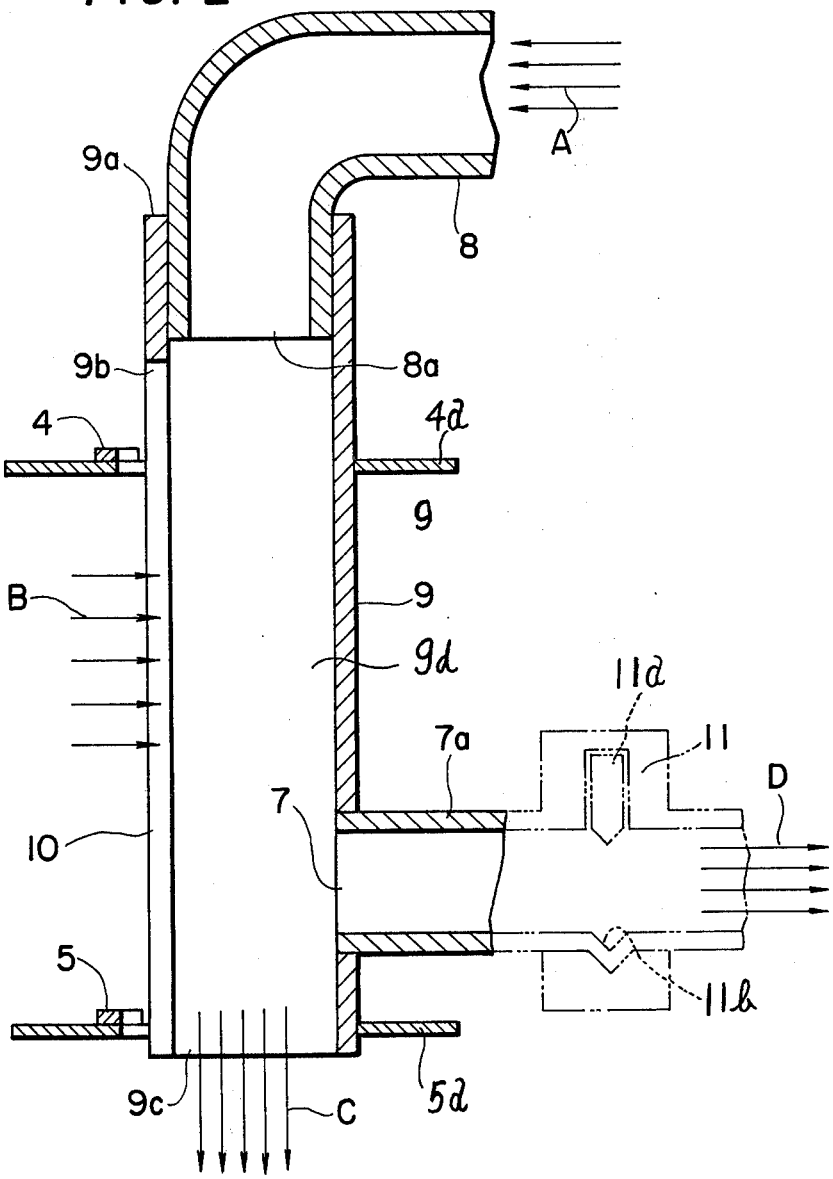
FIG. 2 is substantially an axial section of the unit shown in FIG. 1.
Figure 6:
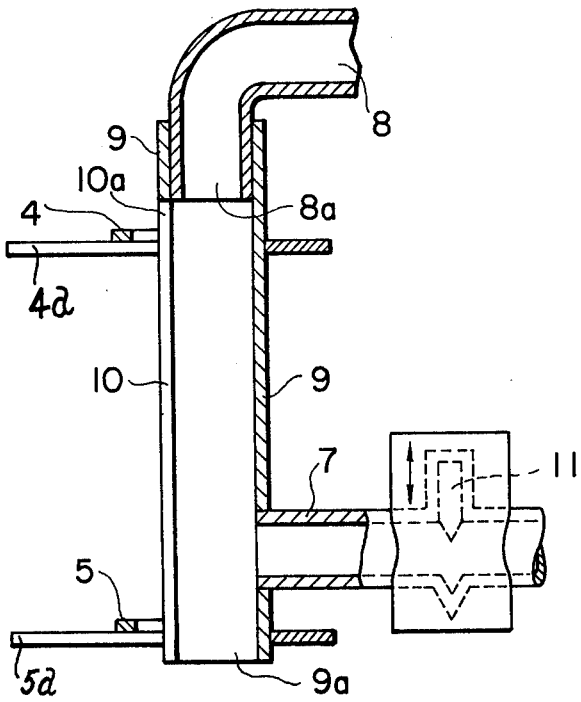

FIG. 6 is a similar view to FIG. 2, showing only a slight modification of the foregoing and at a considerably reduced scale, wherein the yarn-sucking slot has been extended slightly upwards and two upper and lower stationary yarn guides are shown as if they should have been arranged in somewhat offset position from that shown in FIG. 2, for clear representation of respective longer arm walls of these guides adapted for sliding contact with the yarn when the latter is being subjected to its regular bobbin winding operation.

Figure 1:
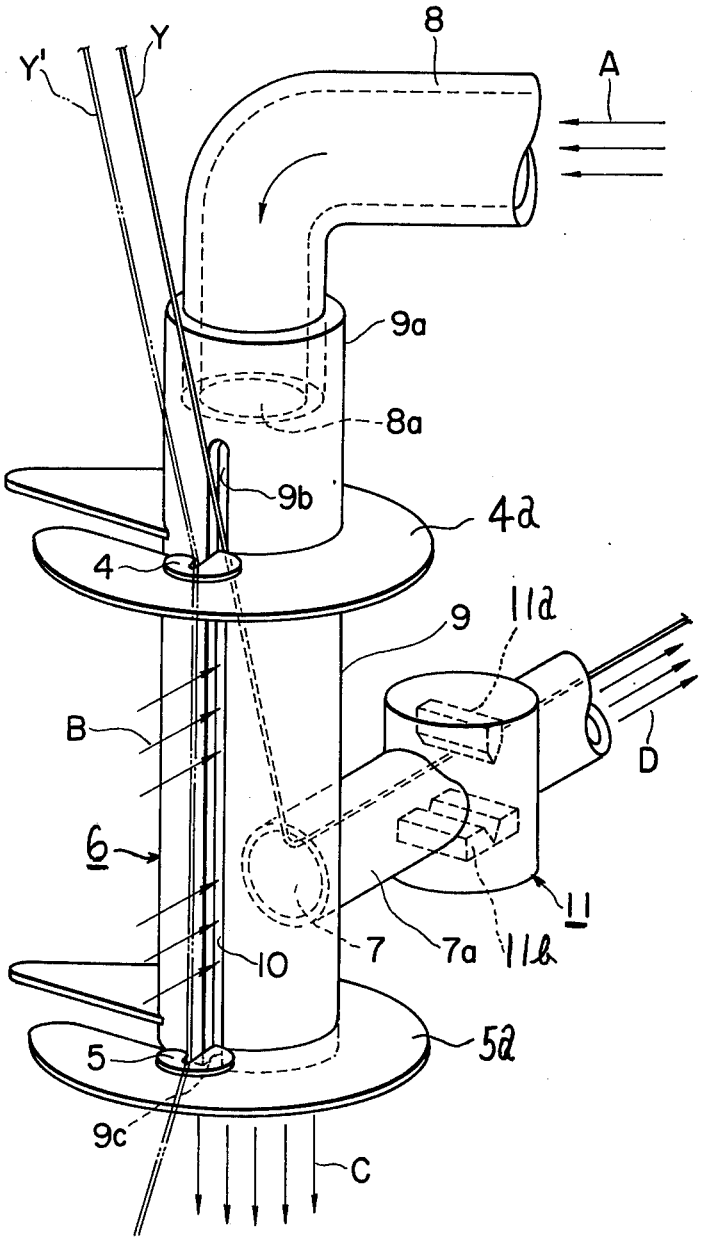
Figure 3:
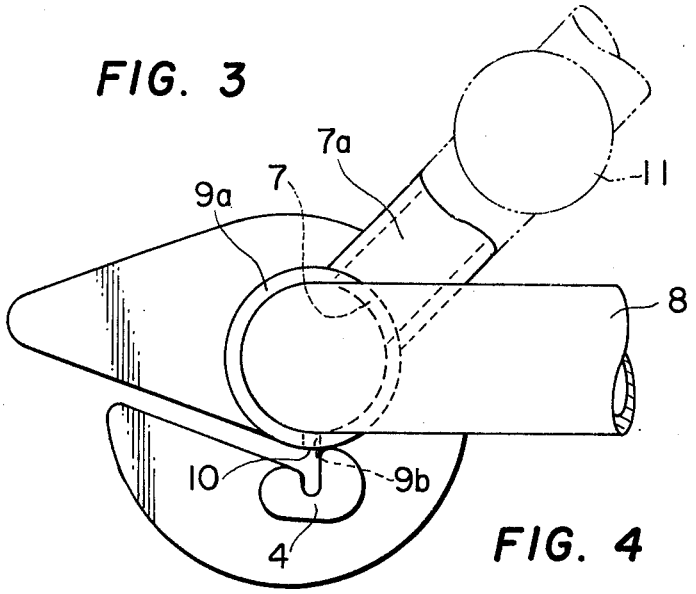
FIG. 3 is a top plan view of the unit shown in the foregoing, yet in somewhat reduced scale.
Figure 7:
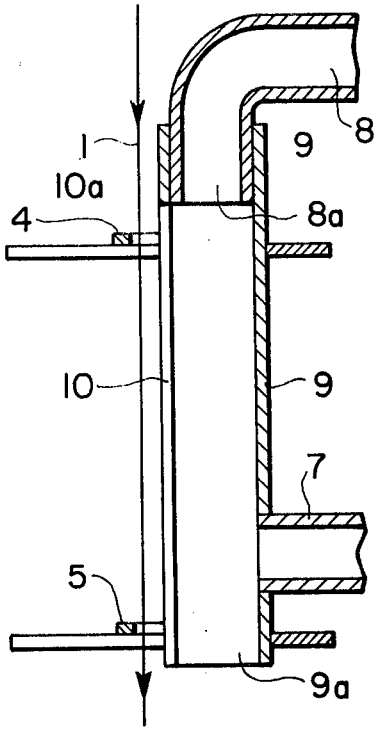
Figure 8:
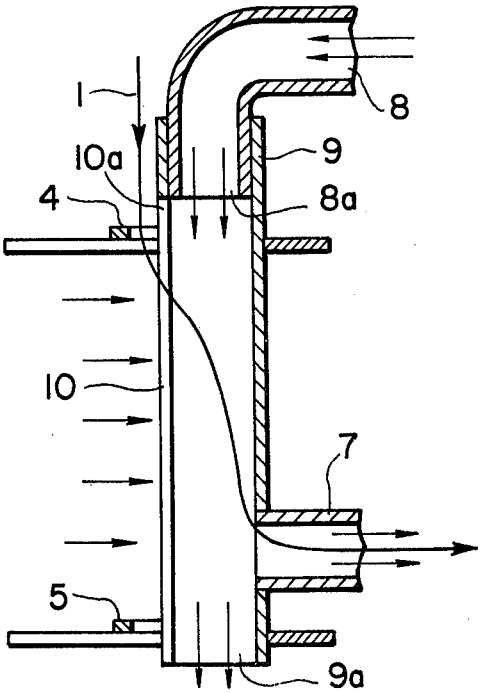
Figure 9:
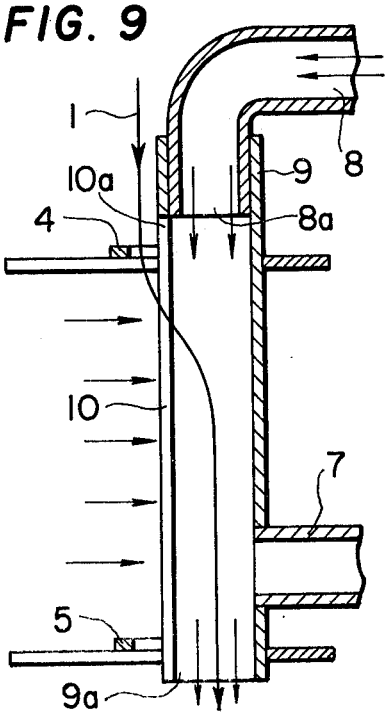

FIGS. 7 – 9 are similar views to FIG. 6, showing several successive working stages of the unit shown in FIGS. 1 – 3.

Figure 10:
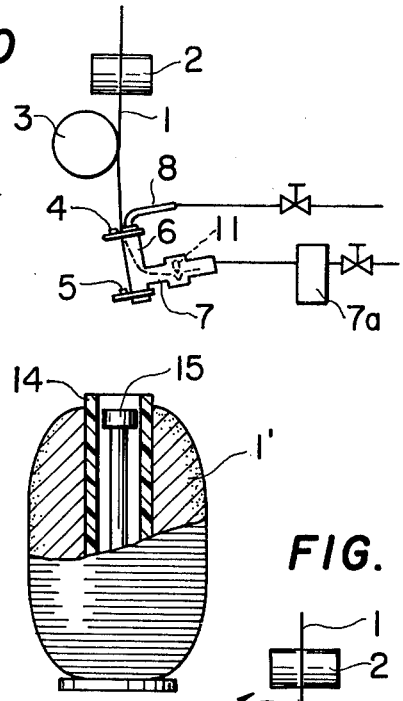

FIG. 10 is a schematic and partially sectioned view of a combined arrangement of said unit with a bobbin winder at the fully wound-up stage thereof wherein however the latter is shown in somewhat exaggerated manner.

Figure 11:
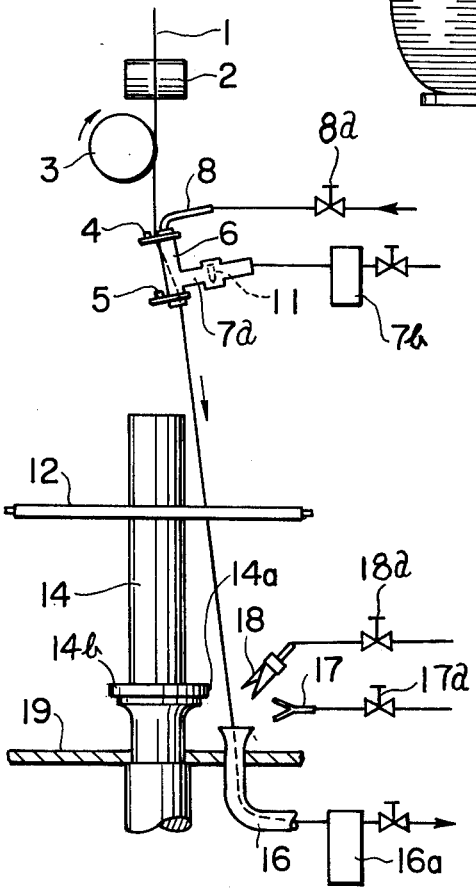
Figure 12:
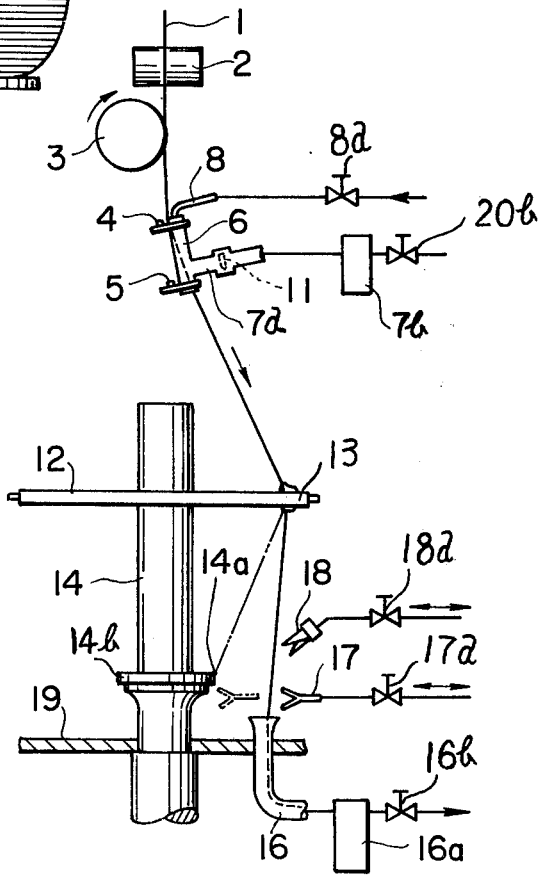

FIGS. 11 and 12 are partially sectioned, schematic elevational views of the said combination arrangement substantially shown in FIG. 10, illustrating however two other operating stages thereof.

Figure 13:
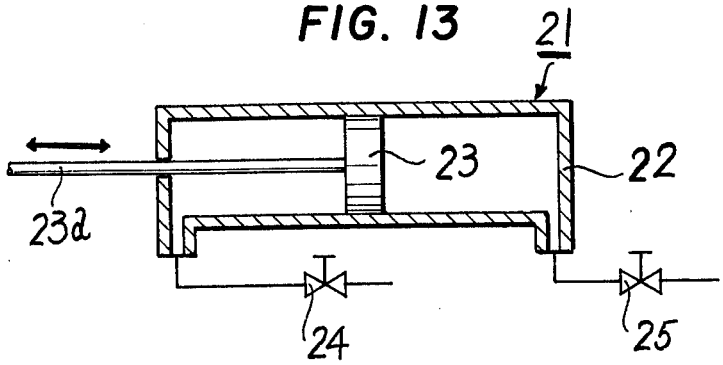

FIG. 13 is an enlarged sectional view of a fluid operated, double acting piston-cylinder unit adapted for cooperation of each of a yarn cutter and a yarn pusher shown in FIGS. 11 and 12.

In the following, the invention will be explained with reference to the first embodiment thereof which is illustrated in FIGS. 1 – 3.

In these figures, numeral 8 represents a compressed air supply piping which is connected with a pressure air reservoir, compressor, blower or the like supply source, not shown, the air flow therethrough being hinted by arrows "A." Outlet end of the piping or conduit 8 is turned down at right angles as shown and snugly fitted into upper end 9*a* of a sleeve 9 having a longitudinal slot 10 cut completely through the wall thereof. As shown, the upper end of slot 10 is closed at 9*b* while the lower end thereof is opened at 9*c*.

When the pressure air is fed through the inlet conduit 8 in the direction shown by the arrows "A" and discharged from the outlet end 8*a* thereof into the interior space 9*d* of the sleeve 9, and thence finally into the open atmosphere, as shown by a second groups of arrows "C," strong negative air pressure will be generated within the said space 9*d* and thus ambient air will invade from outside thereinto through said slot 10, as shown schematically by a third group of arrows "B."

The uppermost end of sleeve 9 is tightly closed and the upper end 9*b* of said slot 10 is situated at a small downward distance from the closed sleeve end. The upper end zone 9*b* of sleeve 10 is adapted for receiving a yarn end Y as will be more fully described hereinafter. The sleeve extends longitudinally of and substantially in parallel to the central axis of said sleeve 9.

At a small distance measured upwards from the open lower end of the sleeve 9, a lateral suction piping 7 merges integrally therewith, thus establishing a lateral branch air passage from the interior space 9*d* of the sleeve.

At an intermediate point of the suction piping 7, the end terminal being connected with a suction blower or the like mechanical suction source, not shown, there is provided an enlarged cutter box 11 in which a vertically movable cutter knife 11*a* and a stationary die 11*b* cooperable therewith. If the yarn is fine, this cutter unit may be omitted.

When the above mentioned yarn guide unit is attached to an automatic bobbin exchanger to be described, and when seen in the yarn travelling direction, the unit is positioned in proximity to the traverse- or balooning starn point. When a bobbin is under its operating condition for winding up the yarn in its traversingly reciprocating state, the yarn takes its passage route as shown by a imaginary double line Y′, being slidingly guided in and by a pair of longitudinally remote yarn guides 4 and 5. The upper yarn guide 4 is situated at a small vertical distance downwards from the closed slot end 9*b* and in close proximity to the slot 10. The guide 4 is fixedly mounted on a support flange 4*a* which is fixedly attached in a substantially embracing manner to the outer peripheral surface of the sleeve 9 by welding or the like conventional fixing means.

The lower yarn guide 5 is situated at proximity to the lower end of sleeve 9 and in close proximity to the slot 10. The guide 5 is fixedly mounted on the similar support flange 5*a* which is also fixedly attached to the sleeve 9.

When the bobbin has been brought into its fully wound-up state and thus, a new one should be exchanged therefor, the air-sucker connected to the outer end of the lateral piping 7*a*, not shown, is operated to work, the yarn is moved instantly from the normal position Y′ to an offset position Y. More specifically, the yarn running substantially parallel to and outside of the sleeve 9 is sucked through slot 10 into the interior space 9*d* thereof in the direction of the arrows "B" and further into the suction piping 7*a*, as a waste yarn in the direction of the arrows "D." The thus sucked and discharged waste yarn is accumulated in a waste yarn box, not shown, which is connected to an extension of the lateral piping 7*a*, and downstream of the said sucker.

During this waste discharge operation, pressure air may preferably be fed also to the inlet pipe 8 for accentuating the vacuum creation in the sleeve interior 9*d*. This auxiliary measure is especially convenient when the yarn winding speed is very high. If occasion requires, the pressure air supplied to inlet pipe 8 may be replaced by pressurized water.

After a short time from initiation of the waste yarn discharge through the lateral piping 7*a*, it is preferable to actuate the cutter unit 11*a*; 11*b*, preferably electromagnetically operated although not shown, so as to cut the yarn in proximity to the sleeve outlet at 9*c* or so. However, if the yarn is fine, such cutting operation can be omitted.

The lower yarn guide 5 defines the starting point of the yarn ballooning, as will be more fully described hereinafter and properly positions the yarn running substantially in parallel to the axis of the sleeve. By the provision of this yarn guide, the desired offset discharge of the waste can be executed rather more easily than otherwise.

On the other hand, the upper yarn guide 4 serves for the determination of the initial point of said regular yarn parallel passage and for giving convenience of said waste discharge.

When the full bobbin is receded from its regular operating position for execution of a bobbin exchanging job and a new one is brought to its working position in place of the former, a sensing means, not shown, will sense such state and actuate a pressure air supply means, for instance an electromagnetic valve, for supplying pressure fluid to the inlet pipe 8 so as to create a vacuum pressure within the sleeve interior 9*d* in the aforementioned manner. When the suction system for discharge of waste yarn is operating, said sensor means control the waste discharge suction so as to stop its operation and actuate the cutter unit 11*a*; 11*b*. Then, the cut yarn end will be discharged through the outlet end 9*c* of the sleeve 9 in the direction of the arrows "C" at a faster speed.

Figure 5:
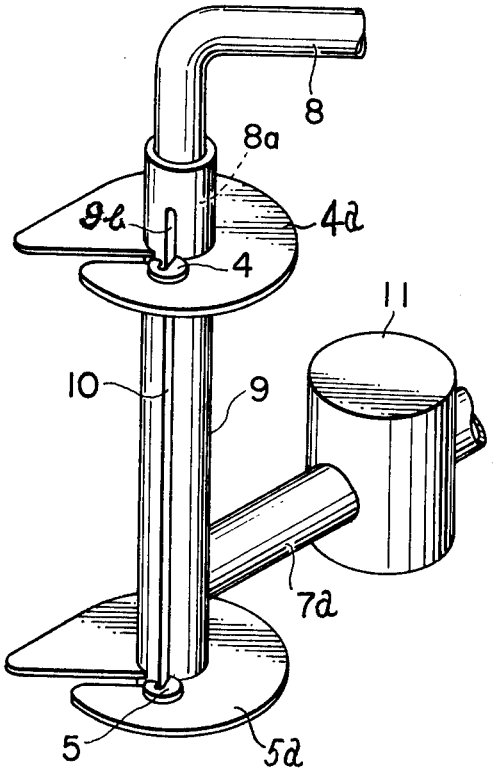
FIG. 5 is a further perspective elevational view of the unit shown in FIGS. 1 – 3, drawn to somewhat reduced scale, wherein however yarn passage routes have been omitted for clearer understanding of main constituent parts of the unit and for showing the ready-for-yarn reception stage thereof.

FIG. 5 represents the said variable passage yarn guide arrangement expressed in a upper skew view for better understanding thereof.

Figure 4:
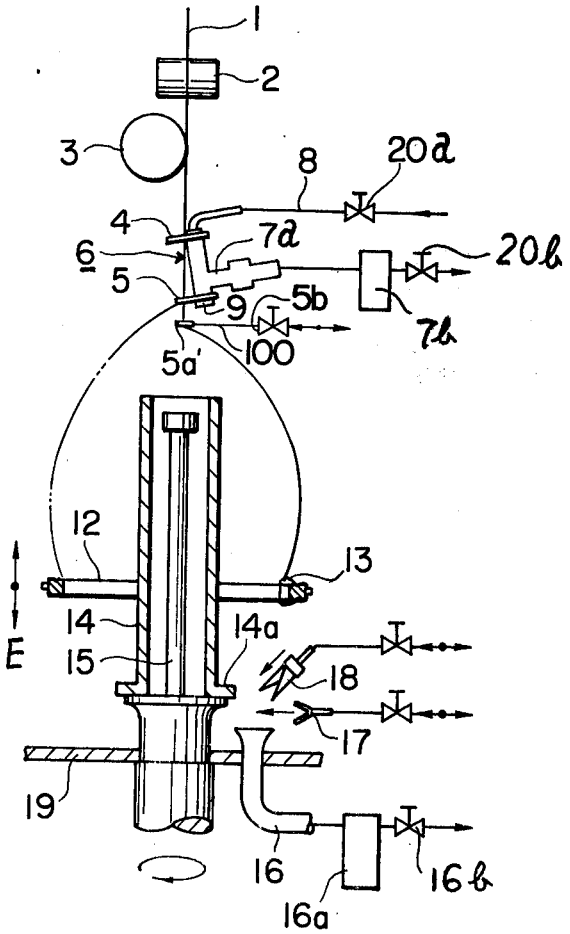
FIG. 4 is a partially sectioned schematic view of an embodiment of the yarn winding arrangement according to this invention, yet drawn at a highly reduced scale when compared with the foregoing.

Next, referring to FIG. 4, showing the said yarn guide arrangement combined with an automatic bobbin exchanger, the numeral 1 represents said yarn in a more generalized sense, which is supplied from a yarn supply source, such as a continuous spinning unit, not shown. This yarn 1 is at first brought into sliding contact with a conventional oiling roller 2 while it is supplied continuously at a constant speed. Then, it passes around a godet roller 3 and fed to the yarn guide arrangement shown generally at 6. Numerals 4; 5; 5*a*; 7*a* and 8 represent several foregoing parts shown in and described with reference to FIGS. 1, 2, 3 and 5. The position of lower yarn guide 5 defines the starting point of a yarn balloon as was described hereinbefore and now clearly illustrated. As seen, the arrangement 6 is positioned in close proximity to the ballooning starting point.

The yarn 1 is caught by a conventional ring traveler 12 which naturally defines the terminal end of the said yarn balloon.

The inlet pipe 8 is fitted with a on-off valve 20*a* which is preferably of the electromagnetic type. The waste yarn suction piping 7*a* is fitted with the waste box 7*b* and an on-off valve 20*b*, the latter being preferably of the electromagnetic type.

During the regular yarn winding operation, the yarn passes outside of the sleeve 9, by being guided by the guide pair 4 and 5, as was referred to hereinbefore.

If the yarn is passed at this stage through the interior of sleeve 9, the wall of the latter could be subjected to severe wear by contact with the yarn which runs at a high speed and soon and considerably deteriorated by possible accumulation of oil droplets projected from the running yarn.

The ring traveler 12 is arranged concentrically to and reciprocatingly around the winding bobbin 14 which is mounted detatchably on a winding spindle 15. The reciprocating movement of the ring traveler 12 is shown only schematically by a double-headed arrow E in FIG. 4.

The spindle 15 is rotatably mounted on a stationary base member 19 of a conventional yarn winding machine, not completely shown.

A second waste yarn suction nozzle 16 is positioned in close proximity to the root portion of the spindle 15 and fixedly mounted on the base 19 in a slightly upwardly protruding manner. The extension of the suction nozzle 16 constitutes a piping which is fitted with a second waste box 16*a* and an on-off control valve 16*b* in the similar way as at 7*b* and 20*b* shown in the upper part of the same FIG. 4. The terminal end of the extension piping from the suction nozzle 16 is connected with an air sucker, although not shown. As may be supposed, the discharging direction of the yarn guide arrangement or unit directs precisely towards the upper opening end of this second waste suction nozzle 16.

During the normal yarn winding stage, the yarn 1 takes its regular route outside of the sleeve 9 as specifically shown in FIG. 7. This yarn passage route corresponds to the chain-dotted lines at Y′ in FIG. 1. Naturally, at this stage, the ring traveler 12 reciprocates up and down and the spindle 15 rotates at a high speed and together with the bobbin 14. The unit 6 does not operate pneumatically in any way at this stage.

In FIG. 8, the first waste yarn suction unit 7*a* operates which state will occur when the bobbin 14 attains at its fully wound state as shown in an enlarged mode at the lower part of FIG. 10. The main yarn suction and projecting unit 8 is also under its operating stage. From FIG. 8, the waste yarn passage could be clearly understood. However, the representation is somewhat schematic and rather wavy. The practical route is a rather broken line route.

In FIG. 9, the yarn route is shown which will occur when the main suction unit 8 continues to operate, while the first waste yarn unit 7*a* has terminated its operation. However, the second waste yarn suction unit 16 is brought to its operating condition concurrently. In this case, also, the representation is of rather more schematic and wavy. In practice, the route may be rather of broken line mode. This operating condition corresponds to that shown in FIG. 11.

Referring now to FIG. 10, when the bobbin 14 attains its full state as shown at 1′, the first waste suction unit 7*a* is caused to operate as was referred to. After a short time, say 2 seconds, from the operation of the unit 7*a*, a cutter unit 18 positioned in close proximity to the upper sucking end of the second waste suction nozzle 16 is advanced directly thereabove and an attached on-off control valve 16*a* is opened to operate the cutter of known design pneumatically and only instantly for cutting off the yarn. Thus, the severed yarn end is sucked into the first waste suction nozzle or unit 7*a*, as was referred to. Then, the cutter unit 18 is receded from its working position, not shown, to its off-service one shown in FIGS. 11 and 12.

During this waste yarn discharge stage which will extend normally one minute or so, the automatic exchanger operates and the full bobbin 15 carrying the fully wound-up yarn mass 1' is exchanged by a new one. At this stage, the main yarn suction and projecting unit 8 is operated at a substantially reduced air discharge rate by controlling its attached valve 8*a*, or perfectly ceased to operate. Upon completion of the bobbin exchange, the unit 8 is operated to discharge the air at its full and strong rate. And at the same time, the second waste yarn suction nozzle or unit 16 is caused to operate. Then, the yarn end is projected from the outlet end of the sleeve 9 towards the second suction nozzle 16 and conveyed fluidically unto the second waste box 16*a*. This yarn projecting distance may amount to 70 cm or more. This state is shown in FIG. 11.

The position of the second waste suction nozzle 16 is so selected that the drawn-in yarn automatically caught at its intermediate position by a yarn guide element 13 fixedly mounted on the ring traveler 12, although its position is shown in FIG. 12 at a somewhat offset position from the real one only for the purpose of clearer understanding of the automatic yarn catching operation. The thus intermediately caught yarn passage route is shown in FIG. 12 in full line.

Then, a fork type yarn pusher 17 is advanced from its off-service position shown by full line in FIG. 12 to its service position shown schematically in chain-dotted line, for catching the yarn portion now extending between the catcher element 13 and the sucking opening of the unit 16 and for forwarding the yarn towards a further yarn catcher 14*a* formed into a projection, recess or hook as conventionally, for being caught thereby as shown in chain-dotted line shown therein. This yarn catcher 14*a* is formed or mounted on a circular flange 14*b* made integral with the spindle 14. Once after the yarn double catching operation established in the aforementioned way, the yarn pusher 17 is receded to its original off-service position by manipulating its attached control valve 17*a* which may preferably of the electromagnetic type, although not shown.

If occasion may demands, such mechanical yarn pusher may be replaced by a pressure fluid type yarn projector constituted by several proper members 8; 9 and the like. In this case, the slot 10 may be dispensed with.

An initial yarn threading operation which should be executed at the first initiating stage for initiating the operation of the yarn winder machine may be equally carried out as having been described with reference to FIGS. 11 and 12 in the foregoing.

As the last stage, the waste yarn end can be severed by operating the yarn cutter 18. After initiation of the regular yarn winding operation has been initiated by the new bobbin, all the units 8; 7*a* and 16 are kept at their off-service position without supply of any operating fluid. Then, the yarn will take its regular passage route at Y' shown in FIG. 1.

For advancing and receding the yarn pusher 17 or yarn cutter 18, a conventional fluid operated, double-acting piston cylinder unit 21 may be used which comprises a stationary cylinder and a piston 23 having a piston rod 23*a* and slidably mounted therin. This unit 21 is formed with two control valves 24 and 25 so as to optionally reciprocate the piston 23. For automatic arrangement, these valve may preferably be of the electromagnetic type. For the reciprocating motion control of the unit 17 or 18, it is mounted on the piston rod 23*a*. Naturally, the piston can be stationary when the cylinder is made movable. In this modified case, the unit 17 or 18 may be mounted on the movable cylinder.

According to our practical experiments, it has been found that for the realization of the automatic bobbin exchange, the aforementioned two stage waste yarn discharge means are highly effective for the accurate operation and for the economizing the operating space. The automatic bobbin exchange was highly difficult when it is intended to the ring traveler type yarn winder, substantially on account of highly crowded space conditions. But, by employment of the present invention, the possibility of success can be foreseen with certainty.

As a further merit, it has been found that the amount of the waste yarn can be considerably reduced according to our experiment.

Although the foregoing description has been directed to one bobbin only, a simultaneous variable passage yarn guide arrangement may be fitted one to one to a series of yarn winding bobbins and these arrangements may be on-off controlled simultaneously, although such series has been omitted from the drawings on account of its obviousness from the foregoing disclosure.

As a final and additional disclosure, a certain portion of FIG. 4 is shown in an enlarged view encircled by a small chain-dotted circle. Within this circle, it may be seen that a second fork-shaped yarn pusher 100 is provided horizontally in the similar way as the first one shown at 17. The pusher proper 5*a'* corresponds to that shown at 17*a* in FIG. 12. For the reciprocating movement of the second yarn pusher 100, a similar fluid-operated double-acting piston-cylinder unit 21 shown in FIG. 13 may equally be utilized. During the ballooning of the yarn 1, the second yarn pusher is kept at its advanced operating position which is illustrated in full line and within the small imaginary circle shown in FIG. 4. During the bobbin exchange stage, the second yarn pusher is receded to its off-service position although not shown. At this stage, the related yarn portion will take the form as shown in chain-dotted line.

The embodiments of the invention in which an exclusive property or privilege is claimed are as follows;

1. A yarn winding arrangement for a bobbin comprising a yarn sucking and projecting unit positioned at a distance substantially above said bobbin and in close proximity to the starting point of a yarn balloon, said unit including a first waste yarn sucking means for drawing a cut yarn end after the bobbin is filled and a fluid projection means for directing a cut yarn end toward a bobbin and a second waste yarn sucking means adapted for receiving a yarn projected fluidically from said unit and positioned in proximity of the root end of said bobbin.

2. The yarn winding arrangement of claim 1, wherein said unit comprising a fluid inlet pipe and a sleeve mechanically connected with each other, said sleeve having a longitudinal slot closed at its upper end and opened at its lower end.

3. The yarn winding arrangement of claim 2, further comprising a cutter positioned in close proximity to said second waste yarn sucking means and at a slightly higher level from the yarn receiving upper end of the latter, said cutter being reciprocatingly movable between its receded off-service position and its advanced service position.

4. The yarn winding arrangement of claim 3, further comprising a yarn pusher positioned in close proximity to said second waste yarn sucking means and at a slightly higher level from the upper yarn receiving end of the latter, said yarn pusher being reciprocatingly movable between its receded off-service position and its advanced service position.

5. The yarn winding arrangement of claim 4, wherein said unit is formed with two separated yarn guides so as to guide the yarn substantially along a parallel yarn passage to said sleeve of and positioned outside of said unit, but in proximity thereto, when the bobbin is executing its regular yarn winding operation.

* * * * *